US007220171B1

(12) United States Patent
Riel

(10) Patent No.: US 7,220,171 B1
(45) Date of Patent: May 22, 2007

(54) CUTTING CUP FOR SPHERE MAKING MACHINES

(76) Inventor: Rodney G. Riel, 3781 Jasper Rd., Springfield, OR (US) 97478

( * ) Notice: Subject to any disclaimer, the term of this patent is extended or adjusted under 35 U.S.C. 154(b) by 0 days.

(21) Appl. No.: 11/322,395

(22) Filed: Dec. 30, 2005

(51) Int. Cl.
*B24B 11/10* (2006.01)
*B28D 1/30* (2006.01)

(52) U.S. Cl. ..... 451/50; 125/3

(58) Field of Classification Search ..... 451/50, 451/180, 548, 542, 543; 125/3, 4, 5, 10; 29/899

See application file for complete search history.

(56) References Cited

U.S. PATENT DOCUMENTS

| | | | | |
|---|---|---|---|---|
| 3,024,578 A | | 3/1962 | Mushkin | |
| 3,111,789 A | | 11/1963 | Harmon | |
| 3,133,383 A | | 5/1964 | Chapman | |
| 3,151,419 A | * | 10/1964 | Archie | 451/180 |
| 3,961,448 A | | 6/1976 | Akahane | |
| 6,402,600 B1 | * | 6/2002 | Besch | 451/268 |

FOREIGN PATENT DOCUMENTS

| | | | | |
|---|---|---|---|---|
| DE | 2362395 | * | 6/1975 | 125/4 |
| SU | 1085776 | * | 4/1984 | 451/50 |
| SU | 1122484 | * | 11/1984 | 451/50 |

OTHER PUBLICATIONS

Lapidary Machines, date unknown, see p. 5 of 5, Internet URL www.cabbingmachines.com/sphere-bead$_{13}$ machines.shtml.
Equipment, Barranca Diamond Products, Inc., date unknown, see pp. 3-5, www.sphereheaven.com/equipment.htm.

* cited by examiner

*Primary Examiner*—Robert A. Rose
(74) *Attorney, Agent, or Firm*—Robert E. Howard

(57) ABSTRACT

A cutting cup for a sphere making machine. The cutting cup includes a cylindrical ring having an outer wall, an inner wall, a bottom wall, and a top wall, the top wall having at least one beveled facet angled downwardly from the outer wall to the inner wall. A cutting element is attached to each of the beveled facets. Each of the cutting elements has a cutting edge adapted to at least partially contact a workpiece to be formed into a sphere. A mounting member is attached to the bottom wall of the cylindrical ring for attaching the cutting cup to the spindle of a sphere making machine.

10 Claims, 3 Drawing Sheets

CUTTING CUP FOR SPHERE MAKING MACHINES

BACKGROUND OF THE INVENTION

The present invention relates to an improved cutting cup for sphere making machines.

It is known in the lapidary art to make spheres of rock and similar materials using a sphere making machine. In making rock spheres, the piece of rock is first cut into a perfect cube. The corners of the cube are then cut off, and then the resulting corners cut off again for a total of 32 cuts. The resulting rough sphere is ground so it is fairly rounded, and then placed into a sphere making machine. Machines for making such spheres have either two or three concave grinding cups that are rotated by spindles to grind against the surface of the rock to create a sphere. The interior of the concave grinding cups typically contains a coating of an abrasive, such as 40/50 mesh diamonds sintered to a cup made of cast iron.

Such sphere making machines are commercially available. A two head "little sphere" machine is available as Covington Model 382, and a two head "large sphere" machine is available as Covington Model 381. A three head sphere machine is available as Covington Model 383.

With the conventional grinding cups currently commercially available it typically takes 4–6 hours to form a rock sphere.

SUMMARY OF THE INVENTION

It is an object of the present invention to provide a cutting cup for sphere making machines that greatly reduces the time required to form a sphere.

The cutting cup includes a cylindrical ring having an outer wall, an inner wall, a bottom wall, and a top wall, the top wall having at least one beveled facet. A cutting element is attached to each of the beveled facets. Each of the cutting elements have a cutting edge adapted to at least partially contact a workpiece to be formed into a sphere. A mounting member is attached to the bottom wall of the cylindrical ring for attaching the cutting cup to the spindle of a sphere making machine.

DESCRIPTION OF PREFERRED EMBODIMENTS

The sphere making cutting cup 10 of the present invention includes a cylindrical ring 20, a plurality of identical cutting elements 30, and a mounting member 40 for attaching the cup 10 to the spindle of a sphere making machine.

Figure 1:
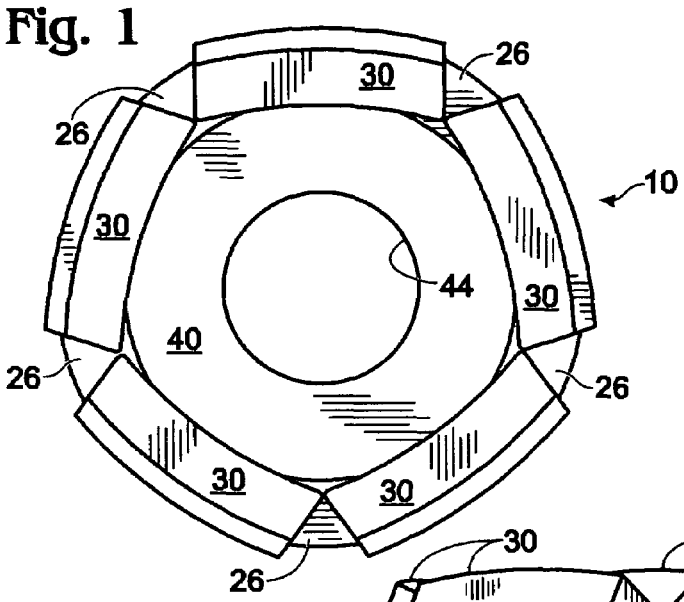
FIG. 1 is a top plan view of the sphere making cutting cup of the present invention.
Figure 2:
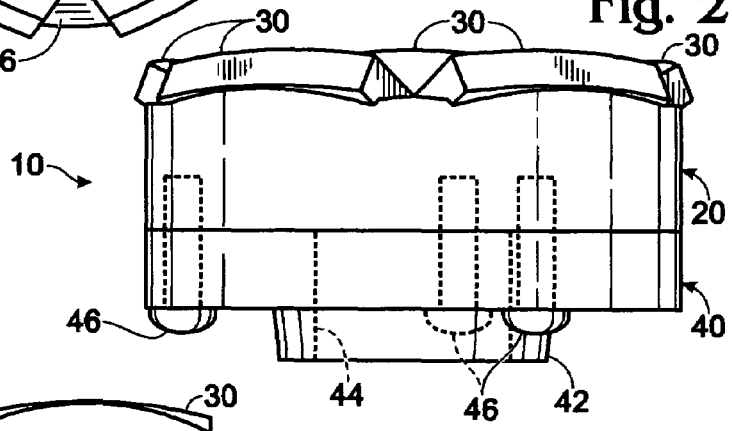
FIG. 2 is a side elevational view of the cutting cup.
Figure 3:
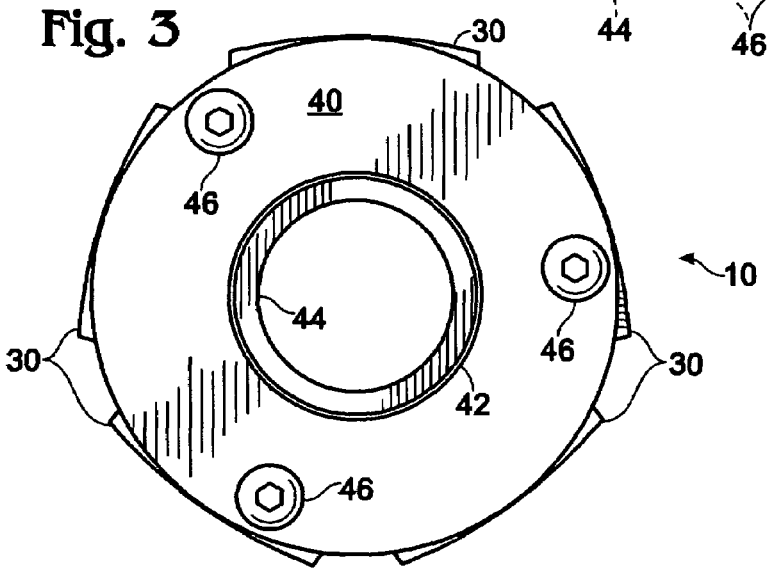
FIG. 3 is a bottom plan view of the cutting cup.
Figure 4:
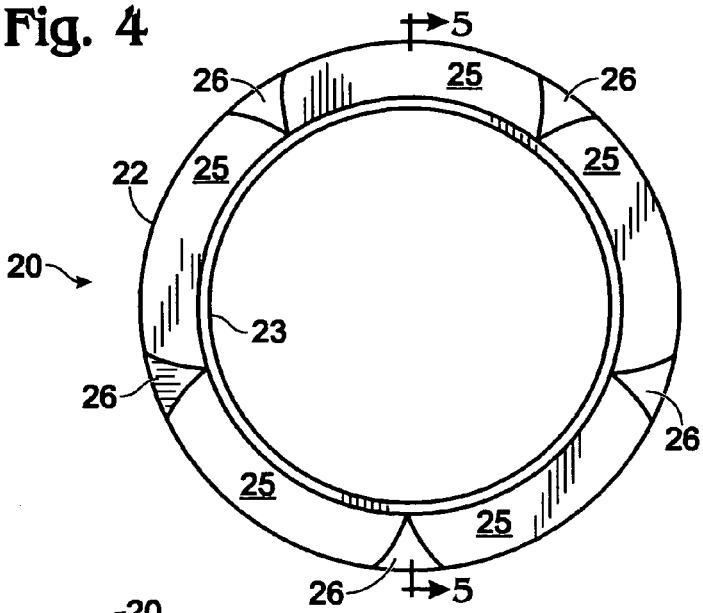
FIG. 4 is a top plan view of the ring subassembly of the cutting cup, shown without the cutting elements in place.
Figure 5:
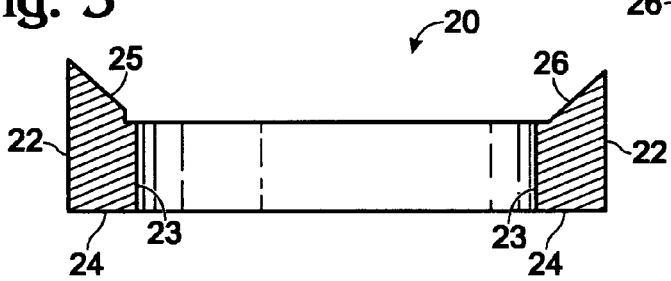
FIG. 5 is a cross-sectional view of the ring subassembly taken along line 5—5 of FIG. 4.

Cylindrical ring 20 is preferably made of mild steel which is powder coated. As best seen in FIGS. 4 and 5, cylindrical ring 20 has an outer wall 22, an inner wall 23, a bottom wall 24, and a top wall formed of a plurality of evenly spaced apart beveled facets 25 adapted to receive cutting elements 30. The beveled facets 25 have an angle sloping downwardly from said outer wall 22 to said inner wall 23. Evenly spaced apart raised triangular stops 26 separate adjacent beveled facets 25, and are adapted to abut the ends of adjacent cutting elements 30, as best seen in FIG. 1.

Figure 6A:
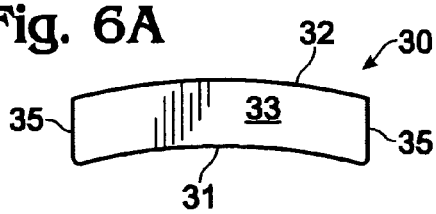
FIG. 6A is a top plan view of a cutting element.
Figure 6C:
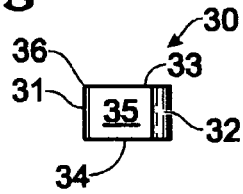
FIG. 6B is a front elevational view of a cutting element.
Figure 6B:
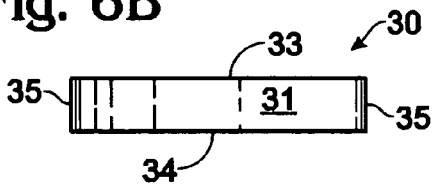

Each cutting element 30 is substantially rectangular in cross-section. As best seen in FIGS. 6A and 6B, each cutting element 30 has a front wall 31, a rear wall 32, a top 33, a bottom 34 and ends 35. Front and rear walls 31, 32 are arcuate and substantially parallel to each other. Front wall 31 is concave and rear wall 32 is convex. The intersection of front wall 31 and top 33 forms a cutting edge 36.

Cutting element 30 is preferably made of a hardened metal alloy containing 40/60 grit diamonds substantially uniformly dispersed throughout. A suitable alloy is one made of silica, nickel and copper. Such a composition has a much longer cutting life than would a cutting element merely coated with an abrasive material.

Cutting elements 30 are soldered onto beveled facets 25. The angle of the beveled facet 25 to the horizontal is such as to cause cutting edge 36 of cutting element 30 to contact the rock workpiece to provide a cutting action. The angle depends on the diameter of the cup 10. For a cup 10 having a diameter of about 7 cm., an angle of about 40 degrees is satisfactory.

The number of cutting elements 30 depends on the diameter of cup 10. For a cup 10 having a diameter of about 7 cm., five cutting elements are preferred, as shown in the drawings.

Sphere making machine mounting member 40 is circular and has the same diameter as ring 20. A hollow cylindrical collar 42 extends downwardly from member 40 in the center thereof. A circular opening 44 extends through the mounting member 40 and collar 42 along the longitudinal axis thereof. The walls of member 40 and collar 42 adjacent circular opening 44 are threaded and adapted to be threaded onto the spindles of a sphere making machine. Mounting member 40 is preferably made of an injection molded plastic, such as ABS.

Mounting member 40 is attached to ring 20 by any suitable means, such as threaded fasteners 46.

Figure 7:
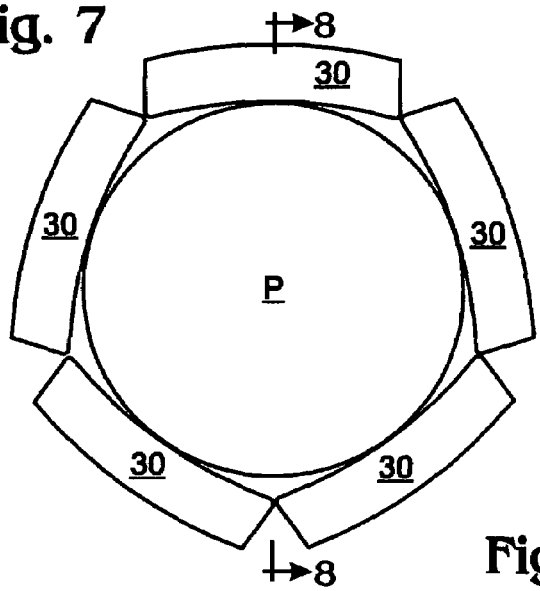
FIG. 7 is a top plan view showing the relationship of the cutting elements to the plane of the rock sphere being machined.
Figure 8:
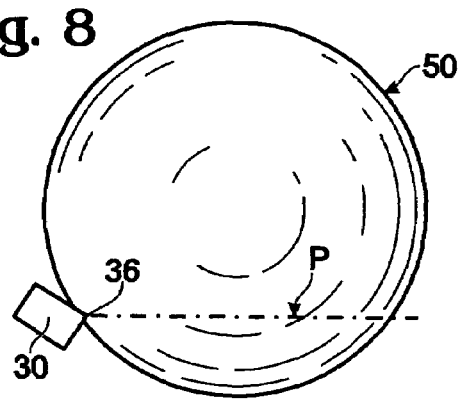
FIG. 8 is a cross-sectional view taken along line 8—8 of FIG. 7.

FIGS. 7 and 8 show the relationship of cutting elements 30 and a sphere 50 being formed in a sphere making machine. The concave inner walls 31 of cutting elements 30 face sphere 50. Initially only a central portion of the cutting edges 36 of cutting elements 30 abuts the surface of sphere 50 at the intersection of plane "P" with the surface of sphere 50. As the cutting edges 36 of cutting elements 30 are worn down by use, more of the cutting edges 36 come into contact with sphere 50, thus prolonging the life of the cutting elements 30. Cutting edges 36 of cutting elements 30 act like the cutting tool used with a workpiece turned by a lathe rather than acting as a grinder as in the prior art grinding cups used with sphere making machines.

When the useful life of the cutting elements 30 has expired, they can be removed from ring 20 and replaced.

Figure 9:
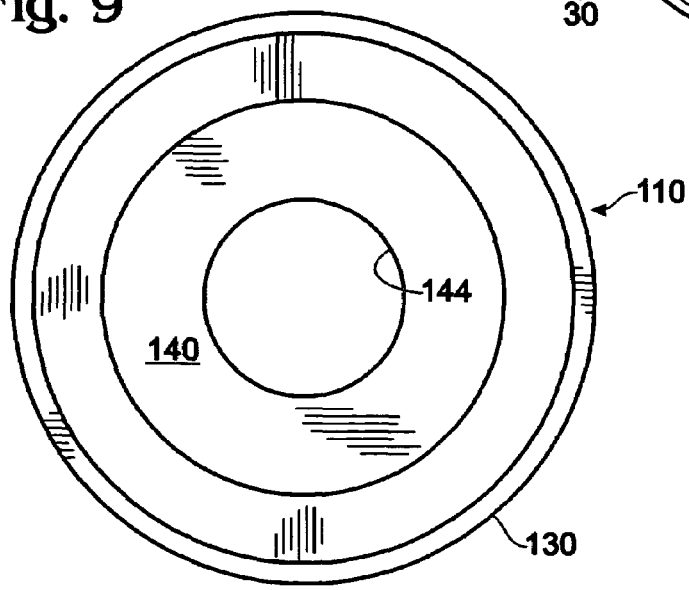
FIG. 9 is a top plan view of a second embodiment of the cutting cup.

Although the segmented cutting elements 30 are preferred, a non-segmented ring-shaped cutting element 130 can be mounted on cutting cup 110. Such a non-segmented cutting element 130 is shown in FIG. 9 mounted onto a cylindrical ring (not shown) that is identical to cylindrical ring 20 except that the top wall thereof is not beveled. The top wall of cutting element 130 is beveled, having an angle sloping downwardly from the outer wall to the inner wall of the cutting element 130. The cylindrical ring of cutting cup 110 is mounted on a sphere making machine mounting member 140 having a circular opening 144. Mounting member 140 is identical to mounting member 40

While the cutting cups 10 and 110 have been described as being used in a sphere making machine for making rock spheres, they can be used to form spheres from any material, such as metal, plastic, etc.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A cutting cup for a sphere making machine comprising:

a cylindrical ring having an outer wall, an inner wall, a bottom wall, and a top wall, said top wall having a plurality of evenly spaced apart beveled facets having an angle sloping downwardly from said outer wall to said inner wall, adjacent facets being separated from each other by a raised triangular-shaped stop member;

a cutting element attached to each of said beveled facets, each of said cutting elements having a cutting edge adapted to at least partially contact a workpiece to be formed into a sphere; and a mounting member for attaching the cutting cup to the spindle of a sphere making machine.

2. The cutting cup of claim 1 wherein said cylindrical ring is made of powder coated steel.

3. The cutting cup of claim 1 wherein said mounting member is attached to the bottom wall of said cylindrical ring, and has a downwardly extending hollow cylindrical collar having internal threads adapted to receive and mate with the threads of the spindle of said sphere making machine.

4. The cutting cup of claim 3 wherein said mounting member is formed of an injection molded plastic.

5. The cutting cup of claim 4 wherein said plastic is ABS.

6. A cutting cup for a sphere making machine comprising:

a cylindrical ring having an outer wall, an inner wall, a bottom wall, and a top wall, said top wall having a plurality of evenly spaced apart beveled facets having an angle sloping downwardly from said outer wall to said inner wall, adjacent facets being separated from each other by a raised triangular-shaped stop member;

a cutting element attached to each of said beveled facets, each of said cutting elements having a substantially rectangular cross-section, a front wall, a rear wall, a top, and bottom and ends, said front wall being concave and said rear wall being convex, the intersection of said front wall and top forming a cutting edge, each of said beveled facets of said ring having an angle to the horizontal such as to cause said cutting edge of said cutting element to at least partially contact said workpiece; and a mounting member for attaching the cutting cup to the spindle of a sphere making machine.

7. The cutting cup of claim 6 wherein said cylindrical ring is made of powder coated steel.

8. The cutting cup of claim 6 wherein said mounting member is attached to the bottom wall of said cylindrical ring, and has a downwardly extending hollow cylindrical collar having internal threads adapted to receive and mate with the threads of the spindle of said sphere making machine.

9. The cutting cup of claim 8 wherein said mounting member is formed of an injection molded plastic.

10. The cutting cup of claim 9 wherein said plastic is ABS.

* * * * *